US007683286B2

(12) United States Patent
Sato et al.

(10) Patent No.: US 7,683,286 B2
(45) **Date of Patent: *Mar. 23, 2010**

(54) SWITCHGEAR

(75) Inventors: Takashi Sato, Mito (JP); Ayumu Morita, Hitachi (JP); Masato Kobayashi, Hitachi (JP); Satoru Kajiwara, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 344 days.

This patent is subject to a terminal disclaimer.

(21) Appl. No.: 11/748,049

(22) Filed: May 14, 2007

(65) Prior Publication Data

US 2007/0262054 A1 Nov. 15, 2007

(30) Foreign Application Priority Data

May 15, 2006 (JP) ..... 2006-135243

(51) Int. Cl.
*H01H 33/66* (2006.01)

(52) U.S. Cl. ..... 218/134; 218/155

(58) Field of Classification Search ..... 218/10, 218/14, 118–121, 134, 139, 140, 143–145, 218/152–155; 361/113, 127
See application file for complete search history.

(56) References Cited

U.S. PATENT DOCUMENTS 3,147,356 A 9/1964 Luehring
4,027,123 A 5/1977 Ihara
4,434,332 A * 2/1984 Yanabu et al. ..... 218/144
4,618,749 A * 10/1986 Bohme et al. ..... 218/134
6,153,846 A 11/2000 Morita et al.

FOREIGN PATENT DOCUMENTS

| | | |
|---|---|---|
| EP | 0 222 073 | 5/1987 |
| JP | 2002-329443 | 11/2002 |
| JP | 2005-108766 | 4/2005 |
| WO | WO 02/29839 | 4/2002 |

* cited by examiner

*Primary Examiner*—Renee S Luebke
*Assistant Examiner*—Marina Fishman
(74) *Attorney, Agent, or Firm*—Brundidge & Stanger, P.C.

(57) ABSTRACT

A switchgear having interrupters wherein at least two moving contacts are capable of being open and close with respect to respective fixed contacts. The switchgear comprises a non-earthed metal vacuum chamber enclosing the interrupters therein, a connection conductor for connecting the moving contacts, an operating rod connected to the connecting conductor by means of an insulator and protruding from the non-earthed metal vacuum chamber, a sealing means for sealing the protrusion of the operating rod at the non-earthed metal vacuum chamber, circuit terminals protruding from the non-earthed vacuum chamber, an earth layer surrounding an outer periphery of the insulating mold, and a potential control means. The control means for controlling the potential of the non-earthed metal vacuum chamber is connected between the circuit terminals and is connected to the non-earthed metal vacuum chamber at the intermediate point of the potential control means.

4 Claims, 7 Drawing Sheets

SWITCHGEAR

CLAIM OF PRIORITY

The present application claims for priority from Japanese application serial No. 2006-135243, filed on May 15, 2006, the content of which is incorporated by reference into this application.

FIELD OF THE INVENTION

The present invention relates to a switchgear having a plurality of interrupters, and more particularly to a switchgear that is capable of eliminating instability of electrical insulating ability of a non-earthed metal vacuum chamber having the plurality of interrupters therein.

RELATED ART

As an example of a conventional switchgear, there has been known a two-poles vacuum circuit breaker wherein two pairs of interrupters connected in series are opened simultaneously to interrupt current. In the switchgear, the pairs of the interrupters are arranged in parallel in a metal vacuum chamber. Fixed contacts of the switchgear are supported by the vacuum chamber by means of dielectric cylinders. The pairs of moving contacts are connected by means of a connecting conductor in the vacuum chamber. The connecting conductor is connected to an operating rod by means of an insulator in the vacuum chamber. A portion between the operating rod and the vacuum chamber is sealed with a sealing means. At the fixed contact side of the interrupters, there are provided two circuit terminals for electrically connecting them with external circuits, i.e. a bus terminal and a load terminal. The non-earthed metal vacuum chamber is surrounded by an insulating mold (cf. Patent document No. 1).

(Patent document No. 1) Japanese Patent Laid-Open 2005-108766

In the above-mentioned conventional switchgear, an earth layer is disposed around the insulating mold thereby to prevent charging-up of the mold. However, since a distance between the earth layer and the non-earthed metal vacuum chamber is small, and since there is the insulating mold between them, static capacitance between the non-earthed metal vacuum chamber and the earth layer becomes large. As a result, an electric potential of the non-earthed metal vacuum chamber becomes close to a potential of the earth potential.

On the other hand, because a potential at the bus terminal becomes 100% and a potential at the load terminal becomes 0% in an open state of the moving electrodes, potentials of the moving contacts and connecting conductor each being electrically connected to one another are determined by allocations of electro-static reactance between the respective fixed contacts and electro-static reactance between the non-earthed metal vacuum chamber and the fixed contacts. Since the latter is larger than the former, the potential of the moving contacts and the non-earthed metal vacuum chamber swerves 50% potential so that the potential becomes close to a potential of the non-earthed metal vacuum chamber, i.e. approximately ground potential. As a result, a voltage dividing ratio of the interrupter at the power source side connected to the bus terminal and the interrupter at the load side connected to a load terminal swerves from 1:1, and the interrupter at the bus terminal side bears almost all of the potential.

SUMMARY OF THE INVENTION

Accordingly, despite of the two-poles vacuum interrupters, the potential allocations at the interrupters greatly differ from each other, and a potential stress on one of the interrupters becomes large. Further, there is instability of electrical insulation strength that is due to floating of the potential of the non-earthed metal vacuum chamber. Thus, there was a problem that the current interrupting ability could not be increased.

The present invention has been made based on the above-mentioned facts, and aims at providing a switchgear capable of improving interrupting capability while eliminating instability of electrical insulation ability due to floating of potential of the non-earthed metal vacuum chamber.

In order to achieve the object of the present invention, an aspect of the present invention there is provided a switchgear having interrupters wherein at least two moving contacts are capable of being open and close with respect to respective fixed contacts, which comprises a non-earthed metal vacuum chamber enclosing the interrupters therein, a connection conductor for connecting the moving contacts, an operating rod connected to the connecting conductor by means of an insulator and protruding from the non-earthed metal vacuum chamber, a sealing means for sealing the protrusion of the operating rod at the non-earthed metal vacuum chamber, circuit terminals protruding from the non-earthed vacuum chamber, an earth layer surrounding an outer periphery of the insulating mold, and a potential control means, connected between the circuit terminals and connected to the non-earthed metal vacuum chamber at the intermediate point of the potential control means, for controlling the potential of the non-earthed metal vacuum chamber. The potential control means includes an impedance element including a condenser, resistor, non-linear resistor and/or linear resistor.

In another aspect of the present invention, the switchgear comprises a potential control means for controlling the non-earthed metal vacuum chamber, wherein the potential control means is connected between the earth layer and the non-earthed metal vacuum chamber.

The potential control means for controlling the potential of the non-earthed metal vacuum chamber may include various impedances such as a capacitor, resistors such as a non-linear resistance, linear resistance, etc.

According to the present invention, it is possible to improve interrupting ability of the switchgear by controlling potential of the non-earthed metal vacuum chamber, because instability of electric insulating ability is eliminated.

EXPLANATION OF REFERENCE NUMERALS

1; non-earthed metal vacuum chamber, 2; interrupter, 3; fixed contact, 4; moving contact, 5; dielectric cylinder, 6; arc shield, 7; endplate, 8; moving holder, 9; connecting conductor, 10; insulator, 11; operating rod, 12; operating device, 13; bellows (sealing means), 14; bus terminal, 15; load terminal, 20; condenser.

PREFERRED EMBODIMENTS OF THE PRESENT INVENTION

In the following, embodiments of the switchgear of the present invention will be explained by reference to drawings.

Figure 1:
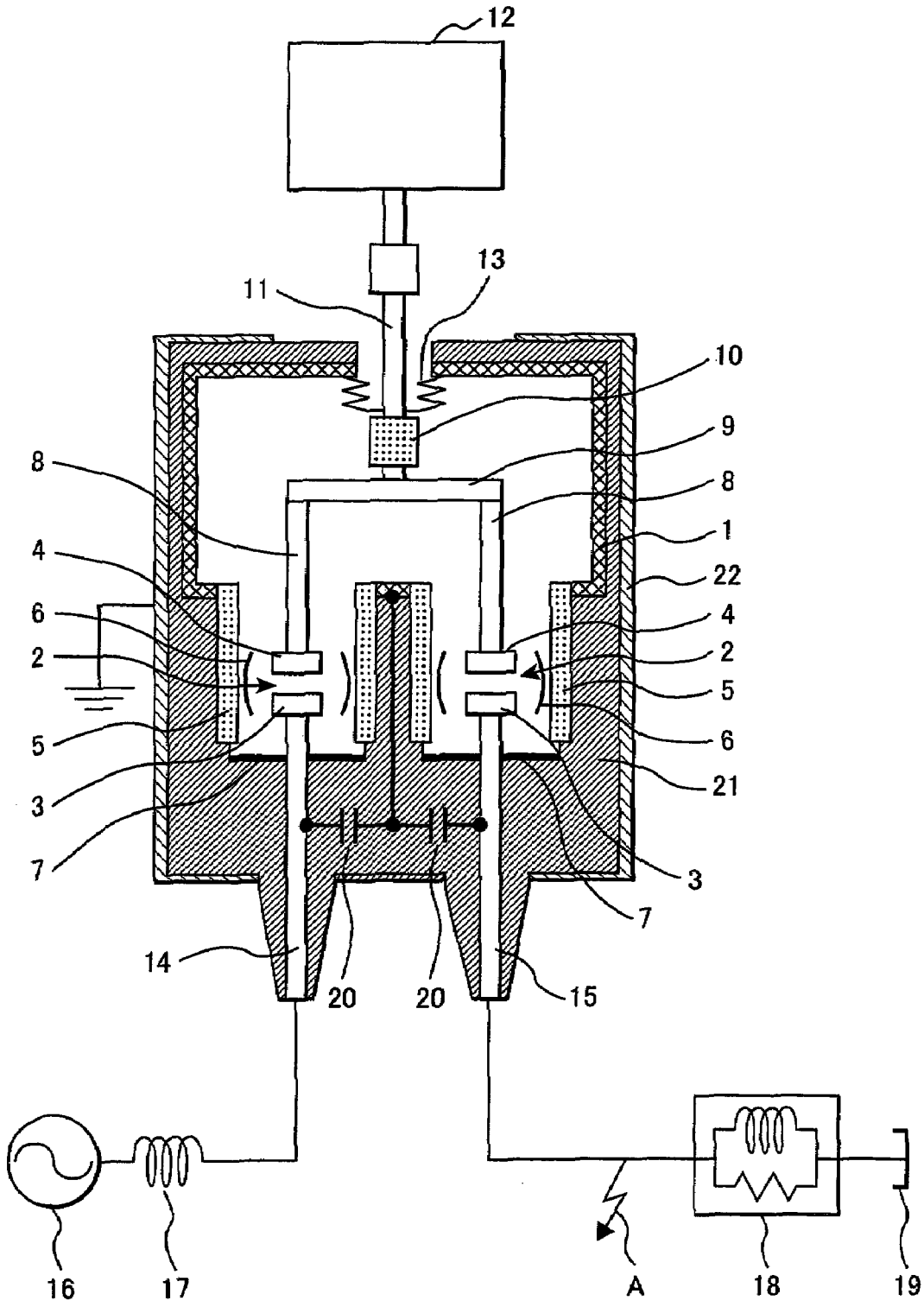
FIG. 1 is a vertical cross sectional view of a first embodiment of a switchgear of the present invention.

FIG. 1 shows a vertical cross sectional view of a first embodiment of a switchgear of the present invention. In FIG. 1, two interrupters 2 are disposed in a non-earthed metal vacuum chamber 1. Each interrupter 2 is provided with a fixed contact 3 and a moving contact 4. Each of the interrupter 2 is disposed in a dielectric cylinder 5. Each dielectric cylinder 5 is provided with an arc shield 6 with a corresponding interrupter therein. A terminal plate 7 is disposed at the fixed contact side of the dielectric cylinder 5.

The moving contacts 4 of the interrupters 2 are supported by respective moving holders 8, which are electro-conductive. The moving holders 8 are connected by means of a connecting conductor 9 to each other. The connecting conductor 9 is connected to an operating rod 11 protruding from the non-earthed metal vacuum chamber 1 through an insulator 10 located in the vacuum chamber. The operating rod 11 is connected to an operating device. A penetrating portion of the operating rod 11 at the non-earthed metal vacuum chamber 1 is sealed with a sealing means 13 such as a bellows.

The fixed contacts 3 of the interrupters 2 are supported by the respective fixed holders 14, 15, which are electro-conductive. The fixed holders 14, 15 are protruded from the non-earthed metal vacuum chamber 1 through the terminal plates 7 to outside of the non-earthed metal vacuum chamber so that they become main circuit terminals for electrically connecting with an external circuit, i.e. a bus terminal and a load terminal. One fixed holder 14 (bus terminal) is, in this example, connected with an alternating current power source 16 and inductance 17 of the network. The other fixed holder 15 (load terminal) is connected with load 18 and a neutral point 19.

Condensers 20, 20 are connected between the one fixed holder 14 (bus terminal) and the other fixed holder 15 (load terminal); an intermediate point of the condensers 20, 20 is connected to the non-earthed metal vacuum chamber 1. The condenser 20, 20 are constituted by static capacitors, in this example. Accordingly, an intermediate potential between the bus terminal 14 and the load terminal 15 is imparted to the non-earthed metal vacuum chamber 1.

The outer peripheries of the non-earthed metal vacuum chamber 1, dielectric cylinders 5, terminal plates 7, fixed holders 14, 15 and condensers 20, 20 are covered with insulating mold 21. Further, the outer periphery of the insulating mold 21 is covered with an earth layer 22 for preventing charging up.

Figure 2:
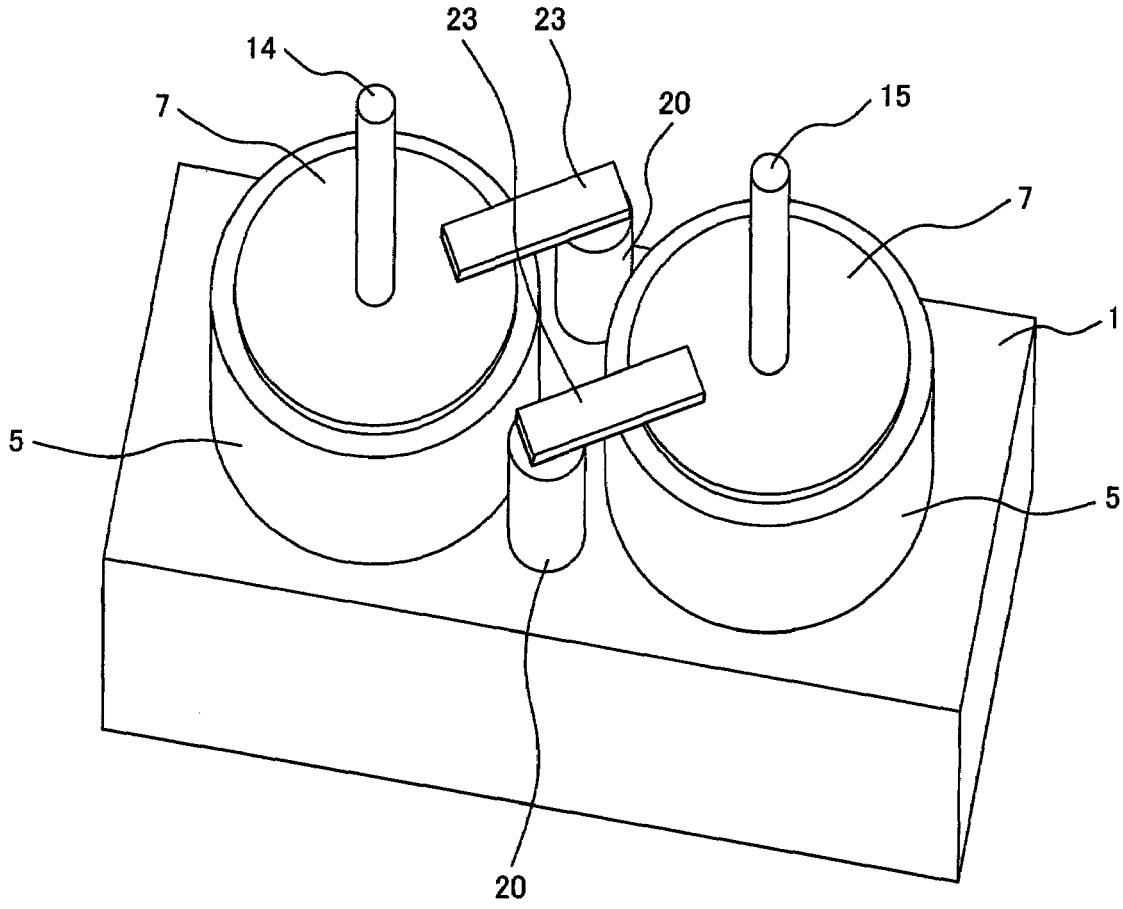
FIG. 2 is a perspective view of dielectric cylinders viewed from the bottom side where the insulating mold and the earth layer are omitted in the first embodiment of the switchgear of the present invention shown in FIG. 1.

An example of a mounting method of the condensers 20, 20 is explained by reference to FIG. 2. FIG. 2 shows a perspective view of the dielectric cylinders 5 viewed from the bottom where the insulating mold 21 and the earth layer 22 are omitted. In this figure, the same reference numerals as those in FIG. 1 denote the same components. Condensers 20, 20 being static capacitance are arranged in such a manner that they are slightly dislocated outwardly in an opposite direction from the intermediate positions of the dielectric cylinders 5. The one end of the condensers 20, 20 being static capacitance is connected to the non-earthed metal vacuum chamber 1 and the other end is connected to the end plates 7 by means of lead conductors 23.

According to the above-mentioned structure, the condensers 20, 20 being static capacitance are mounted so that they are connected to the intermediate position between the bus terminal and the non-earthed metal vacuum chamber 1. Further, since the condensers 20, 20 are arranged in such a manner that they are slightly dislocated outwardly at the intermediate point of the two dielectric cylinders, integration density is increased.

Next, operation of the first embodiment of the switchgear of the present invention will be explained by reference to FIGS. 1 and 2.

In the first embodiment, the bus terminal 14 is connected with the alternating current power source 16 and the inductance 17 of the network and the load terminal 15 is connected with a load 18. In the normal state, the two interrupters 2 are closed and electric power is supplied through the interrupters 2 at the power source side and the load side from the alternating current power source 16 to the load 18.

During this state, potentials at the bus terminal 14 and the load terminal 15 are equally 100% (power source potential), and the potential of the non-earthed metal vacuum chamber 1 becomes 100%, too.

When ground A occurs between the load terminal 15 and the load 18 at this state, fault current flows from the alternating current power source 10 towards the occurrence point of the ground A. As a result, the potential of the bus terminal 14 and the load terminal 15 decreases to almost 0% (earth potential).

When the both interrupters 2 are opened by detecting fault current with a protection relay, fault current is interrupted at current zero point so that potential of the bus terminal rises to 100%, but potential of the load terminal 15 stays at approximately 0%. At this time, potential of the non-earthed metal vacuum chamber becomes 50%, which is divided to potential difference between the bus terminal 15 and the load terminal 14 and is born by condensers 20 as the static capacitance.

On the other hand, potential of the moving holder 8, connecting conductor 9 and moving contact 4, which are electrically connected to one another, is determined by static reactance between the fixed contacts 3 and the non-earthed metal vacuum chamber 1; since the latter is larger than the former, the potential of the non-earthed metal vacuum chamber 1 is drawn to the 50% potential so that instability of the electric insulation strength is eliminated.

As a result, a voltage divided ratio between the interrupter 2 at the power source side connected to the bus terminal 14 and the interrupter 2 at the load side connected to the load terminal 15 is approximately 1:1, whereby the potential stress imparted to each of the interrupters is alleviated to thereby improve interrupting ability of the interrupters 2.

According to the first embodiment of the present invention, since the potential of the non-earthed metal vacuum chamber can be controlled by connecting the condenser 20 to the non-earthed metal vacuum chamber 1, the instability of the insulating performance is eliminated. As a result, interrupting ability of the interrupters 20 can be improved.

Further, since the voltage divided ratios of the plural interrupters 2 are improved, potential stress imparted on each of the interrupters 2 is alleviated. As a result, a gap between the contacts can be made small, and the switchgear can be downsized. Further, since it is possible to reduce a interruption speed of the movable side of the interrupters 2, a cost of the switchgear can be made small.

In addition to the above, the control of the potential of the non-earthed metal vacuum chamber 1 leads to an advantage to eliminate instability of the electrical insulation performance.

Figure 3:
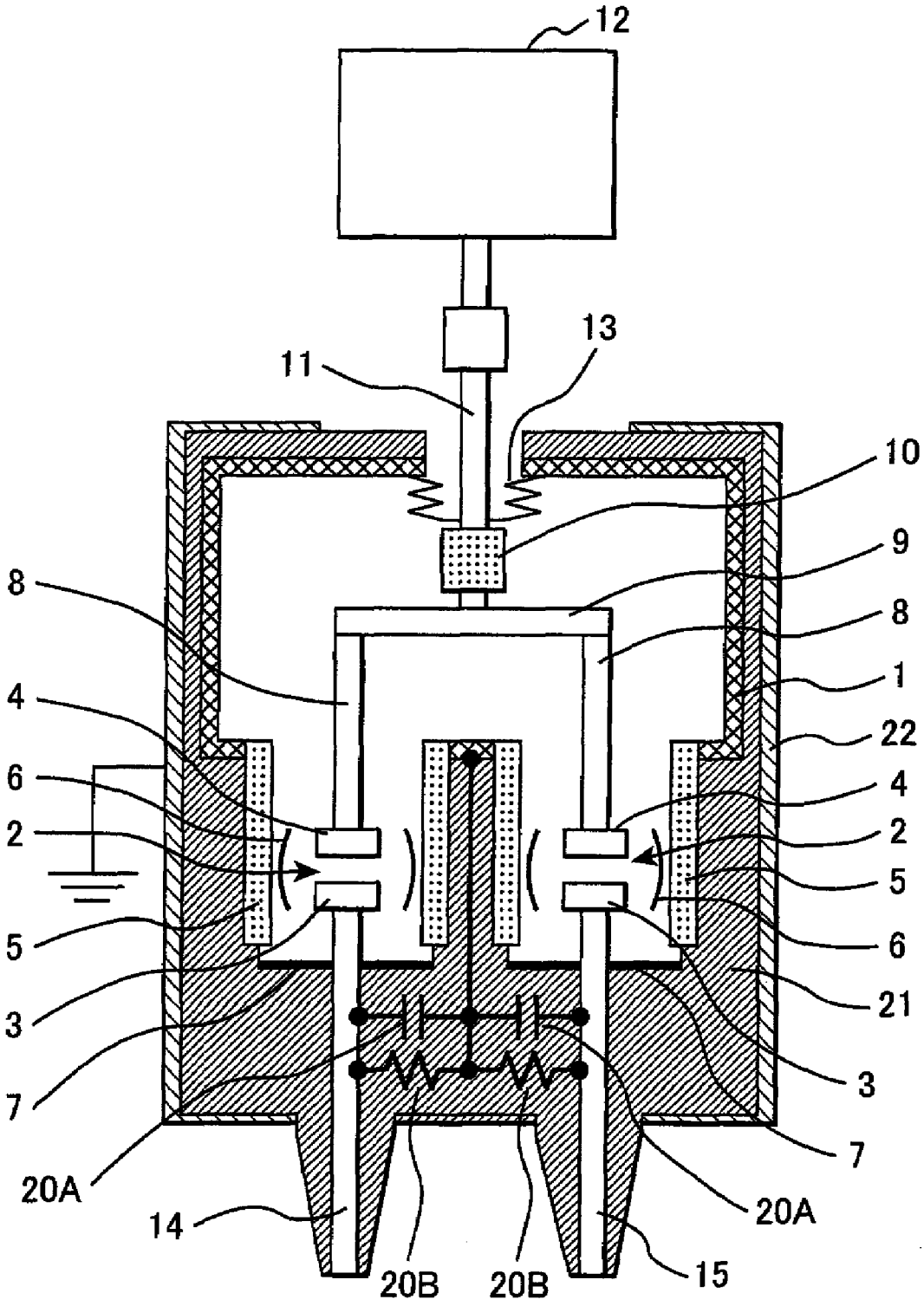
FIG. 3 is a vertical cross sectional view of a second embodiment of a switchgear of the present invention.

FIG. 3 shows a vertical cross sectional view of a second embodiment of a switchgear of the present invention, which will bring about the similar advantages as does the first embodiment. In FIG. 3, the same reference numerals as in FIG. 1 denote the same components as in FIG. 1; detailed explanations thereof are omitted.

In this embodiment, condensers 20A and resistor 20B are connected in parallel between circuit terminals 14, 15, i.e. between the bus terminal 14 and the load terminal 15. The impedance is constituted by the capacitor 20A or resistor 20B.

In this embodiment, advantages similar to those of the first embodiment will be obtained. Further, when time-constants of the static capacitor 20 A and resistor 20B are optimized, it is possible to expand a controllable frequency area of the non-earthed metal vacuum chamber until a low frequency area.

Figure 4:
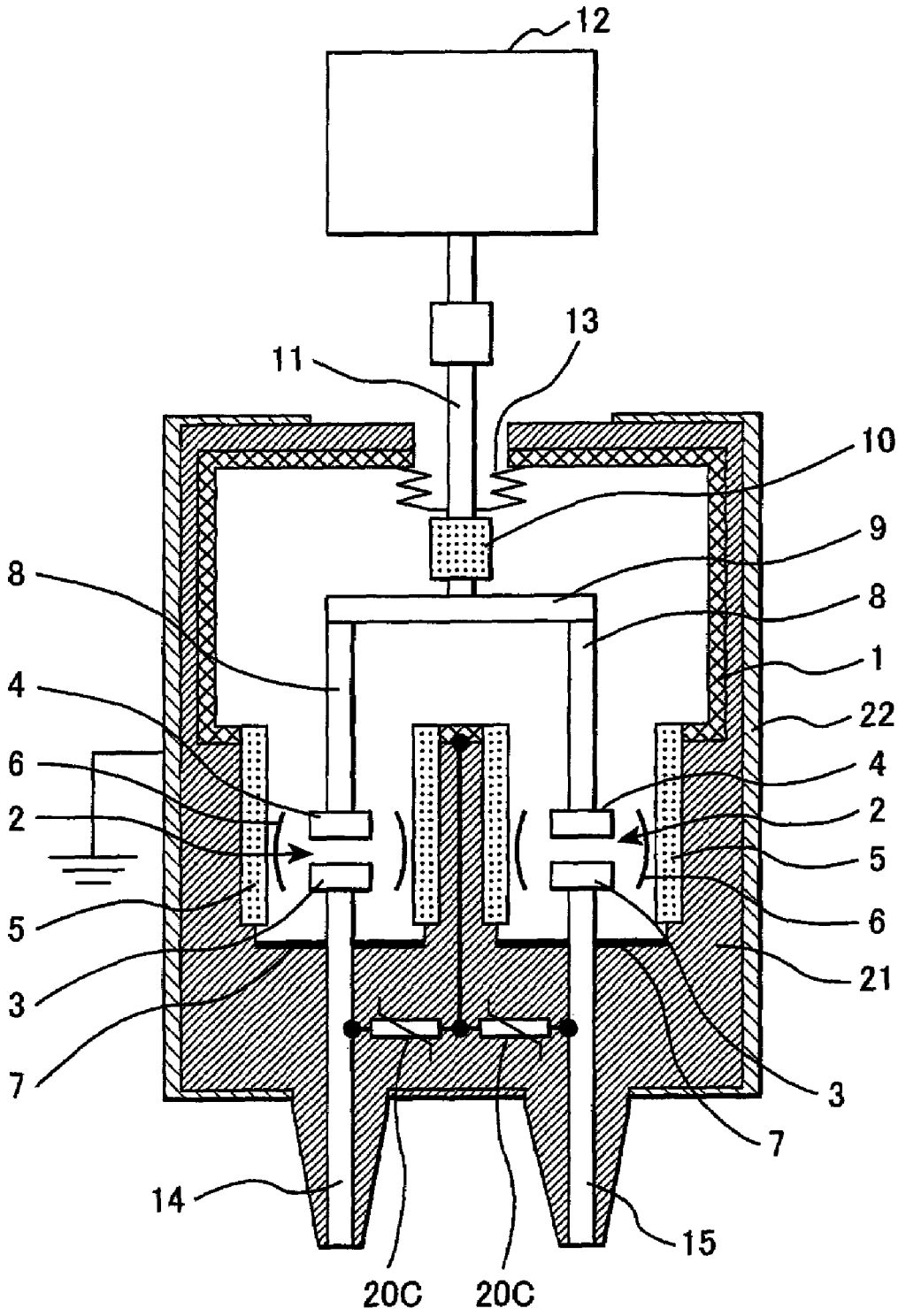
FIG. 4 is a vertical cross sectional view of a third embodiment of a switchgear of the present invention.

FIG. 4 shows a vertical cross sectional view of a third embodiment of a switchgear of the present invention. In FIG. 4, the same reference numerals as in FIG. 1 denote the same components as in FIG. 1; detailed explanations thereof are omitted.

In this embodiment, the impedance 20 such as non-linear resistor 20C is connected between the circuit terminals, i.e. bus terminal 14 and the load terminal 15.

According to this embodiment, since potential stresses imparted on each interrupter 2 does not exceed a varister voltage of the non-linear resistor 20C, it is possible to prevent a progress of electrical breakdown of one pole to a two pole series electrical breakdown between the circuit terminals in the same phase, the breakdown at the contacts of one interrupter 2 being followed by another breakdown triggered at the other contacts of the other interrupter 2. Accordingly, the advantages of the above-described embodiments are obtained.

Figure 5:
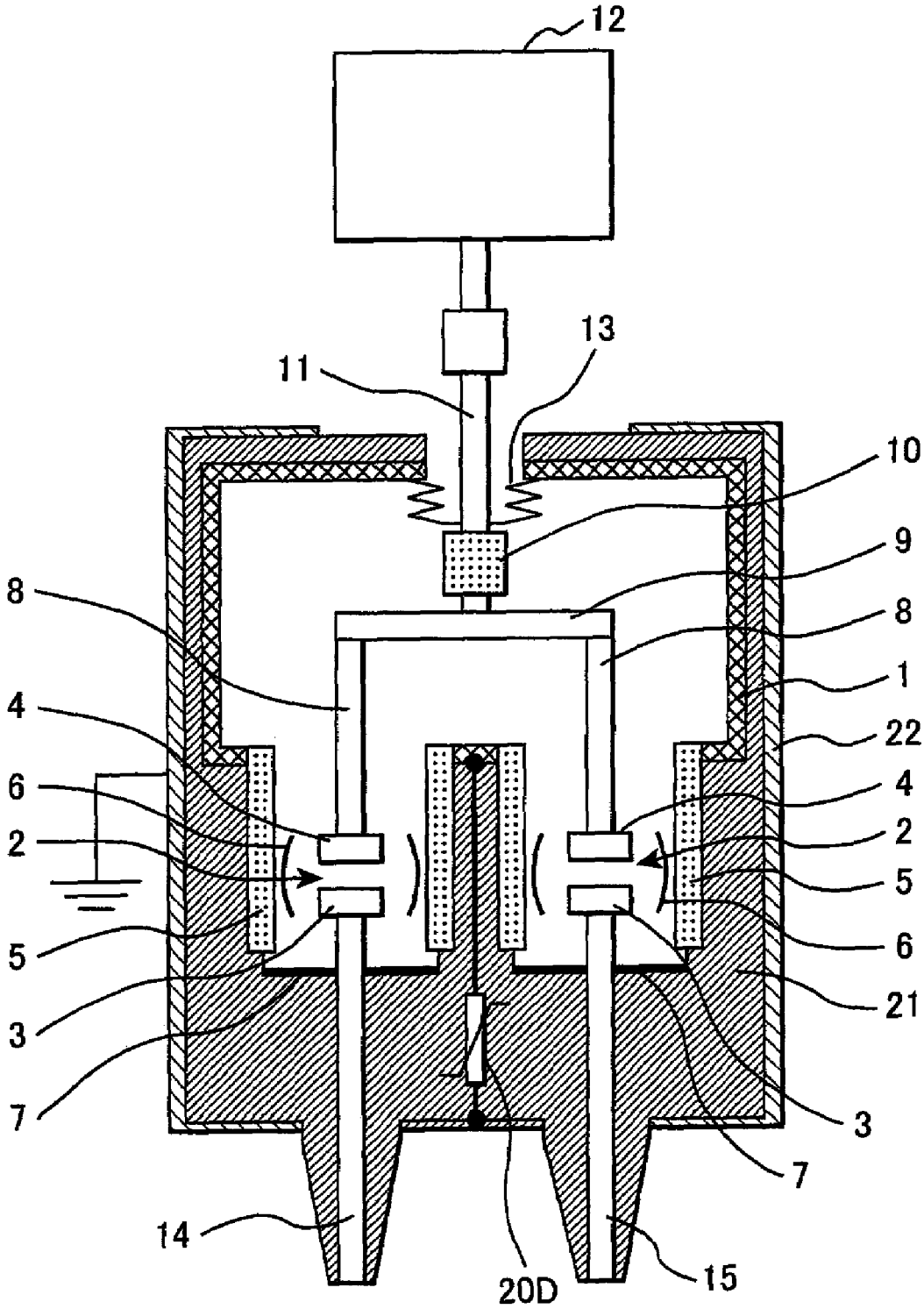
FIG. 5 is a vertical cross sectional view of a fourth embodiment of a switchgear of the present invention.

FIG. 5 shows a vertical cross sectional view of a fourth embodiment of the switchgear of the present invention. In this figure, the same reference numerals as those in FIG. 1 denote the same components as in FIG. 1; detailed explanations thereof are omitted. In this embodiment, impedance such as non-linear resistor 20D is connected between the non-earthed metal vacuum chamber 1 and the earth layer 22. This condenser is constituted by a non-linear resistance 20D.

According to this embodiment, even if a ground voltage of the non-earthed metal vacuum chamber 1 increases due to continued application of unipolar voltage, the potential does not exceed the varister voltage of the non-linear resistance 20D. As a result, the withstanding resistance becomes stabilized.

As same as in the embodiments having been described, the switchgear can be downsized and its cost can be lowered.

Figure 6:
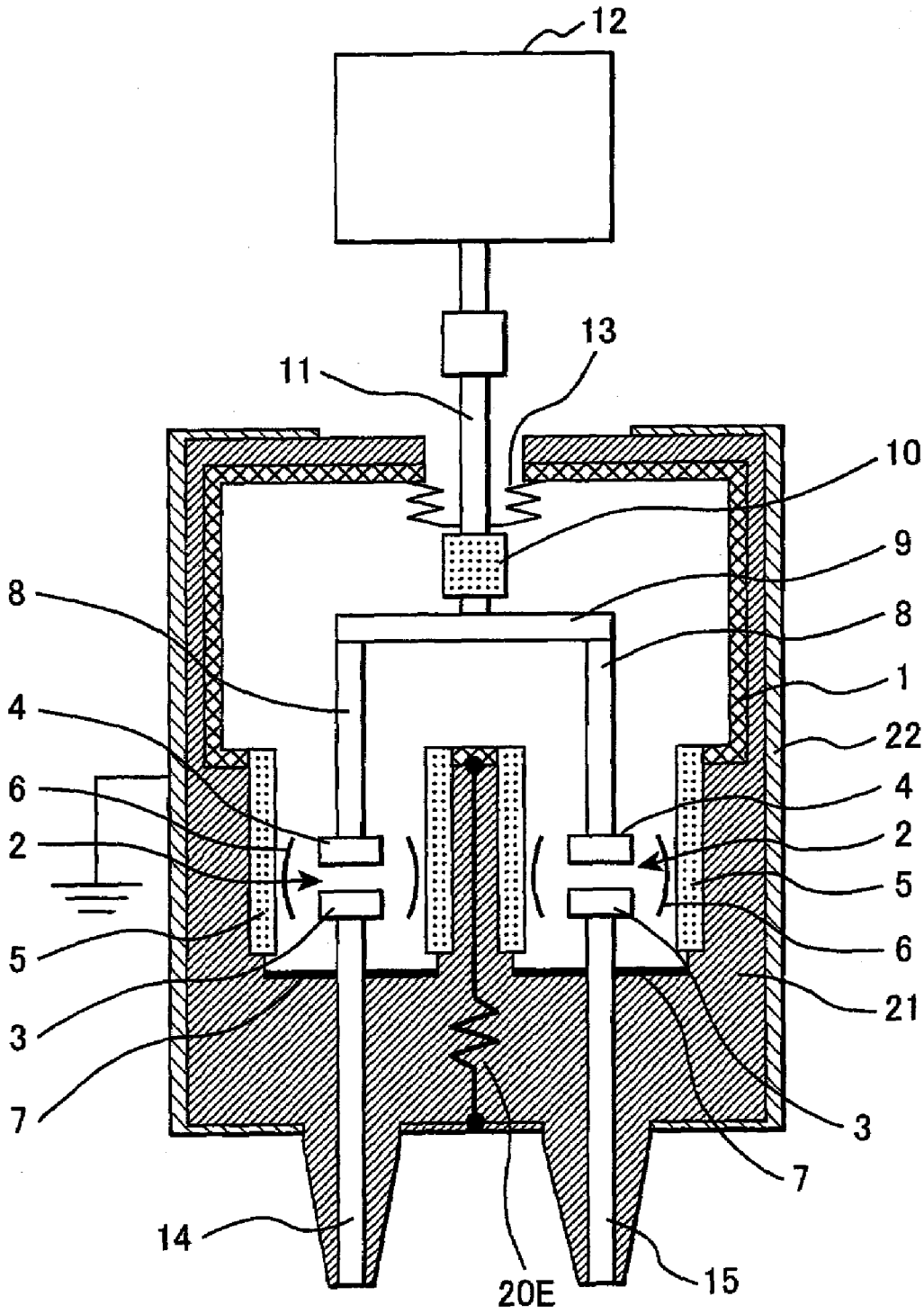
FIG. 6 is a vertical cross sectional view of a fifth embodiment of a switchgear of the present invention.

FIG. 6 shows a vertical cross sectional view of a fifth embodiment of the switchgear of the present invention. In FIG. 6, the same reference numerals as those in FIG. 1 denote the same components as in FIG. 1; detailed explanations thereof are omitted.

In this embodiment, a linear resistance 20E is connected between the non-earthed metal vacuum chamber 1 and the earth layer 22.

According to this embodiment, even if the ground voltage of the non-earthed metal vacuum chamber 1 increases due to continued application of unipolar voltage, the insulation withstanding performance becomes stabilized because the non-earthed metal vacuum chamber I recovers to the earth voltage by a time constant determined by a static capacitance between the non-earthed metal vacuum chamber 1 and the earth layer 22 and a resistance value of the linear resistance 20E. Further, as same as in the previous embodiments, it is possible to downsize the switchgear and to lower a cost of the switchgear. Compared with the fourth embodiment, the potential of the non-earthed metal vacuum chamber 1 is controlled at a low cost.

Figure 7:
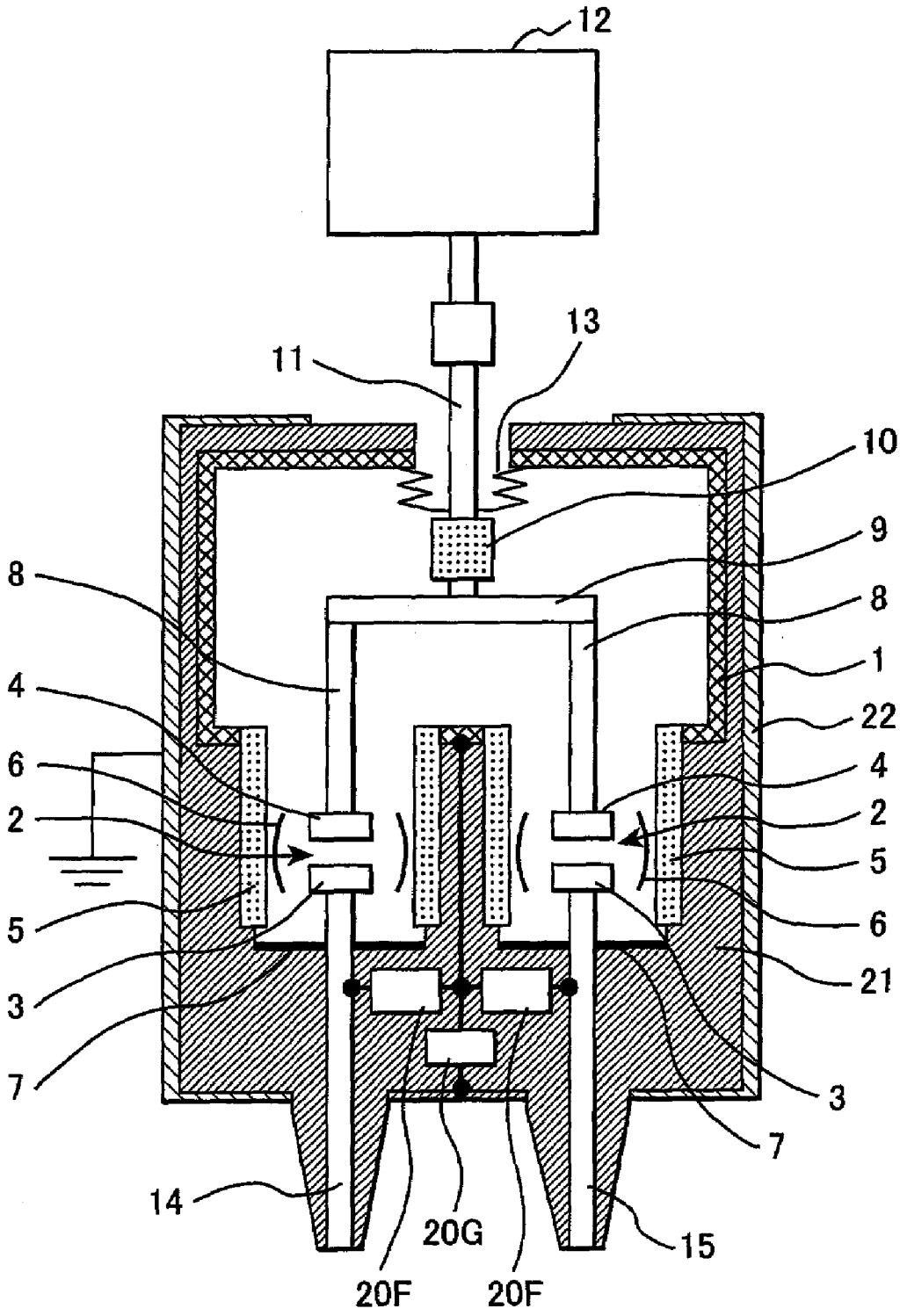
FIG. 7 is a vertical cross sectional view of a sixth embodiment of a switchgear of the present invention.

FIG. 7 shows a vertical cross sectional view of a sixth embodiment of the switchgear of the present invention. In FIG. 7, the same reference numerals as those in FIG. 1 denote the same components as in FIG. 1; detailed explanations thereof are omitted.

In this embodiment, condensers 20 connected to circuit terminals of which intermediate point is connected to the non-earthed metal vacuum chamber 1 and the condensers 20 connected between the non-earthed metal vacuum chamber 1 and the earth layer 22 are arranged.

In this embodiment, advantages similar to those of the previous embodiments are obtained.

Although in the above embodiment, the impedance such as condensers, resistors, linear resistors or non-linear resistors condensers 20 are inserted into the insulating mold 21, it is possible to take out the impedance 20 from the insulating mold 21 and dispose the impedance 20 outside the insulating mold 21.

What is claimed is:

1. A switchgear having interrupters wherein at least two moving contacts are capable of being opened and closed with respect to respective fixed contacts, which comprises a non-earthed metal vacuum chamber enclosing the interrupters therein, a connection conductor for connecting the moving contacts, an operating rod connected to the connecting conductor by means of an insulator and protruding from the non-earthed metal vacuum chamber, a sealing means for sealing the protrusion of the operating rod at the non-earthed metal vacuum chamber, circuit terminals protruding from the non-earthed vacuum chamber, an insulating mold covering an outer periphery of the non-earthed metal vacuum chamber, an earth layer surrounding an outer periphery of the insulating mold, and a potential control means connected between the circuit terminals, a physical intermediate point of the potential control means being connected to the non-earthed metal vacuum chamber for controlling the potential of the non-earthed metal vacuum chamber.

2. The switchgear according to claim 1, wherein the potential control means for controlling the potential of the non-earthed metal vacuum chamber to a potential between the circuit terminals includes a condenser.

3. The switchgear according to claim 1, wherein the potential control means includes a condenser and a resistor both being connected in parallel.

4. The switchgear according to claim 1, wherein the potential control means includes a non-linear resistance.

* * * * *